US009885505B2

(12) United States Patent
Reissner et al.

(10) Patent No.: US 9,885,505 B2
(45) Date of Patent: Feb. 6, 2018

(54) METHOD FOR CONFIGURING THE SIZE OF A HEAT TRANSFER SURFACE

(71) Applicant: Siemens Aktiengesellschaft, Munich (DE)

(72) Inventors: Florian Reissner, Nuremberg (DE); Jochen Schaefer, Nuremberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 50 days.

(21) Appl. No.: 15/110,810

(22) PCT Filed: Jan. 14, 2015

(86) PCT No.: PCT/EP2015/050578

§ 371 (c)(1),
(2) Date: Jul. 11, 2016

(87) PCT Pub. No.: WO2015/107073

PCT Pub. Date: Jul. 23, 2015

(65) Prior Publication Data

US 2016/0334149 A1 Nov. 17, 2016

(30) Foreign Application Priority Data

Jan. 17, 2014 (DE) ..... 10 2014 200 820

(51) Int. Cl.
*F25B 40/06* (2006.01)
*F25B 40/00* (2006.01)
(Continued)

(52) U.S. Cl.
CPC ..... *F25B 40/06* (2013.01); *F25B 40/00* (2013.01); *F28D 7/00* (2013.01); *F28D 9/00* (2013.01);
(Continued)

(58) Field of Classification Search
CPC .... F28F 13/00; F28F 2260/00; F28F 2200/00; F25B 40/06; F25B 2700/21175;
(Continued)

(56) References Cited

U.S. PATENT DOCUMENTS 2,385,667 A 9/1945 Webber ..... 62/509
2005/0016721 A1* 1/2005 Antonijevic ..... B60H 1/00571 165/177
(Continued)

FOREIGN PATENT DOCUMENTS

CN 1682086 A 10/2005 ..... F28D 1/06
CN 201434622 Y 3/2010 ..... F28D 9/00
(Continued)

OTHER PUBLICATIONS

Grote, K. et al., "Taschenbuch für den Mascinenbau," 23, Berlin, Heidelberg; Springer, 20 pages (German language w/ English translation), 2011.
(Continued)

*Primary Examiner* — Emmanuel Duke
(74) *Attorney, Agent, or Firm* — Slayden Grubert Beard PLLC

(57) ABSTRACT

A method is disclosed for producing a heat exchanger having at least one heat transfer surface, wherein the heat is used in a thermodynamic process that uses a fluid that is condensed, expanded, evaporated, and compressed in a cycle process. The area of the heat transfer surface may be dimensioned with respect to a minimum surface area measurement of the heat transfer surface, the minimum surface area measurement being required at least for transmitting a minimum heat quantity to the fluid used with the heat exchanger in order to prevent a condensation of the fluid before, during, and after the compression process. The area of the heat transfer surface may be dimensioned based on a
(Continued)

correlation between the molar mass of the fluid and the minimum surface area measurement of the heat transfer surface.

17 Claims, 3 Drawing Sheets

(51) Int. Cl.
*F28D 7/00* (2006.01)
*F28D 9/00* (2006.01)
*F28F 13/00* (2006.01)
*F28D 21/00* (2006.01)

(52) U.S. Cl.
CPC ..... *F28F 13/00* (2013.01); *F25B 2400/054* (2013.01); *F25B 2500/19* (2013.01); *F25B 2500/28* (2013.01); *F25B 2700/2117* (2013.01); *F25B 2700/21163* (2013.01); *F25B 2700/21173* (2013.01); *F25B 2700/21175* (2013.01); *F28D 2021/0068* (2013.01); *F28F 2200/00* (2013.01); *F28F 2260/00* (2013.01)

(58) Field of Classification Search
CPC ..... F25B 2400/054; F25B 2700/2117; F25B 2500/19; F25B 2700/21173; F25B 2700/21163; F25B 2500/28; F28D 7/00; F28D 9/00; F28D 2021/0068
See application file for complete search history.

(56) References Cited

U.S. PATENT DOCUMENTS

2005/0161205 A1 7/2005 Ashe et al. ..... 165/168
2008/0066488 A1* 3/2008 Take ..... F25B 40/00 62/513
2010/0018246 A1* 1/2010 Wolfe, IV ..... F28D 7/024 62/513
2010/0300665 A1* 12/2010 Denoual ..... F25B 40/00 165/164
2011/0139416 A1* 6/2011 Bernard ..... F25B 40/00 165/154
2012/0067049 A1 3/2012 Woolley et al. ..... 60/671
2013/0068437 A1* 3/2013 Matsumoto ..... B21C 37/151 165/177
2013/0269914 A1* 10/2013 Matsumoto ..... F28D 7/0008 165/104.26
2013/0283841 A1* 10/2013 Markowitz ..... F28D 7/106 62/296
2014/0151004 A1* 6/2014 Liers ..... F28F 1/40 165/154
2014/0202662 A1* 7/2014 Meyer ..... F28D 7/0008 165/104.14
2016/0102902 A1 4/2016 Gromoll et al. ..... 62/115

FOREIGN PATENT DOCUMENTS

DE 102011108800 A1 1/2013 ..... F25B 30/02
JP 2016520187 A 7/1916 ..... F25B 1/00
JP 01247962 A 10/1989 ..... F25B 1/00
JP 2001263831 A 9/2001 ..... F25B 1/00
JP 2002081767 A 3/2002 ..... F25B 1/00
JP 2012141070 A 7/2012 ..... F25B 1/00
JP 2012167852 A 9/2012 ..... F25B 3/00
RU 2244236 C2 1/2005 ..... F28D 9/00
WO 2015/107073 A1 7/2015 ..... F25B 40/00

OTHER PUBLICATIONS

International Search Report and Written Opinion, Application No. PCT/EP2015/050578, 21 pages, Apr. 1, 2015.
German Office Action, Application No. 102014200820.4, 7 pages, Jul. 14, 2015.
Chinese Office Action, Application No. 201580002573.0, 6 pages, May 18, 2017.

* cited by examiner

METHOD FOR CONFIGURING THE SIZE OF A HEAT TRANSFER SURFACE

CROSS-REFERENCE TO RELATED APPLICATIONS

This application is a U.S. National Stage Application of International Application No. PCT/EP2015/050578 filed Jan. 14, 2015, which designates the United States of America, and claims priority to DE Application No. 10 2014 200 820.4 filed Jan. 17, 2014, the contents of which are hereby incorporated by reference in their entirety.

TECHNICAL FIELD

The invention relates to a method for producing a heat exchanger comprising at least one heat transfer surface, which heat exchanger is to be used in a thermodynamic process in which a fluid that is condensed, expanded, evaporated and compressed in a cycle process is used.

BACKGROUND

It is known to use heat exchangers in thermodynamic processes. The heat exchangers are in this case used, in particular, to heat a gaseous working fluid, or fluid for short, to a particular temperature level in order to ensure that the gaseous fluid remains in a gaseous state before, during and after the compression, i.e. respectively before entry into a compression device and after exit from a compression device. In this way, damage to corresponding compression devices due to so-called liquid slugging can be prevented.

Because of existing and future statutory regulations in the context of fluids to be used in corresponding thermodynamic processes, development of chemically complex fluids is to be observed, which are distinguished in particular by their good environmental compatibility as well as their safety properties.

The use of heat exchangers in the scope of thermodynamic processes using such fluids is difficult, in particular, since to date there is no known production method for corresponding heat exchangers, by means of which surface sizing of thermal transfer surfaces on the heat exchanger side is made possible in a technically reliable and satisfactory way, such that heat transfer that prevents condensation of such fluids before, after and during the compression is thereby ensured.

SUMMARY

One embodiment provides a method for producing a heat exchanger comprising at least one heat transfer surface, which heat exchanger is to be used in a thermodynamic process in which a fluid that is condensed, expanded, evaporated and compressed in a cycle process is used, wherein the surface sizing of the heat transfer surface is carried out with a view to a minimum surface area of the heat transfer surface, which minimum surface area is necessary at least for transfer of a minimum amount of heat to the fluid to be used with the heat exchanger to be produced, or produced, in the scope of a thermodynamic process, in order to prevent condensation of the fluid before, after and during the compression, and wherein the surface sizing of the heat transfer surface is carried out on the basis of a correlation between the molar mass of the fluid and the minimum surface area of the heat transfer surface.

In one embodiment, the molar mass of the fluid is initially correlated with the inverse slope of the saturated vapor line of the fluid.

In one embodiment, the inverse slope of the saturated vapor line is furthermore correlated with a minimum required temperature increase of the fluid starting from a given temperature, which minimum required temperature increase prevents condensation of the fluid before, after and during the compression.

In one embodiment, the minimum required temperature increase is furthermore correlated with a minimum required enthalpy difference, which minimum required enthalpy difference represents the amount of heat which must be transferred to the fluid in order to prevent condensation of the fluid before, after and during the compression.

In one embodiment, the minimum required enthalpy difference is correlated with the minimum surface area.

In one embodiment, the correlation between the minimum required enthalpy difference and the minimum surface area is carried out by means of the relationship $\dot{m}\cdot\min\Delta h=k\cdot A\cdot\Delta T$, with $\dot{m}$=fluid mass flow rate, $\min\Delta h$=minimum required enthalpy difference, k=heat transfer coefficient, A=minimum surface area and $\Delta T$=temperature difference between a high-temperature side and a low-temperature side of the heat transfer surface.

In one embodiment, in the scope of the correlation between the molar mass of the fluid and the minimum surface area, at least at least one particular temperature, in particular the temperature of the fluid after the evaporation, and/or a particular heat transfer coefficient and/or a particular temperature difference between a high-temperature side and a low-temperature side of the heat transfer surface is used as a constraint.

In one embodiment, the correlation is carried out for a fluid having a molar mass of more than 150 g/mol.

Another embodiment provides a heat exchanger for use in a thermodynamic process in which a fluid is condensed, expanded, evaporated and compressed in a cycle process, wherein the heat exchanger comprises at least one heat transfer surface, and is produced by a method as disclosed above.

Another embodiment provides a use of a heat exchanger as disclosed herein in a thermodynamic process in which a fluid is condensed, expanded, evaporated and compressed in a cycle process.

BRIEF DESCRIPTION OF THE DRAWINGS

Example aspects and embodiments of the invention are described below with reference to the drawings, in which.

DETAILED DESCRIPTION

Figure 1:
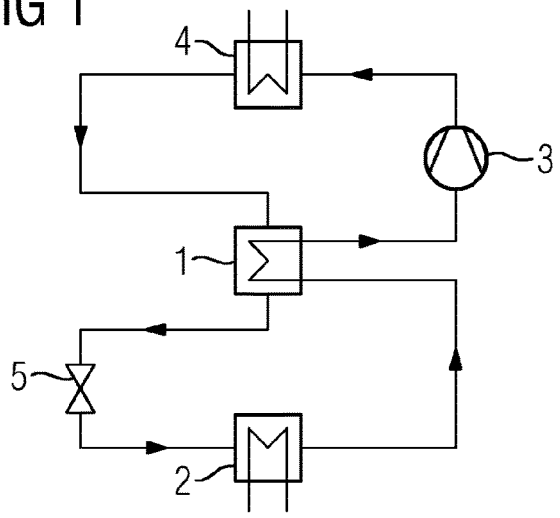
FIG. 1 shows an outline representation of a heat exchanger connected into a thermodynamic process, according to one exemplary embodiment of the invention.

Embodiments of the invention provide an improved method for producing a corresponding heat exchanger.

Some embodiments provide a method for producing a heat exchanger, comprising:

the surface sizing of the heat transfer surface is carried out with a view to a minimum surface area of the heat transfer surface, which minimum surface area is necessary at least for transfer of a minimum amount of heat to the fluid to be used with the heat exchanger to be produced, or produced, in the scope of a thermodynamic process, in order to prevent condensation of the fluid before, after and during the compression, wherein the surface sizing of the heat transfer surface is carried out on the basis of a correlation between the molar mass of the fluid and the minimum surface area of the heat transfer surface.

The principle according to at least some embodiments relates to a technical production method for producing a heat exchanger comprising at least one heat transfer surface. The heat exchanger to be produced, or produced, is to be used in the scope of a thermodynamic process in which a working fluid, or fluid for short, that is condensed, expanded, evaporated and compressed in a cycle process is used. In the scope of the thermodynamic process, the heat exchanger is typically connected between an evaporation device for evaporating the fluid and a compression device, i.e. for example a compressor, for compressing the fluid. The heat exchanger may also be referred to or considered as a recuperator.

The invention thus provides the ability to produce a heat exchanger having a heat transfer surface sized or dimensioned sufficiently in terms of surface area with a view to a thermodynamic process using a particular fluid. The heat transfer surface should be sized or dimensioned in terms of surface area so that sufficient heat transfer to the fluid takes place during operation of the heat exchanger in the scope of the thermodynamic process. There is sufficient heat transfer to the fluid in particular when an amount of heat is or can be transferred to the fluid which—under given process conditions or process parameters of the thermodynamic process in which the heat exchanger is to be used—condensation of the fluid before, after and during the compression is prevented.

In the scope of the disclosed method, surface sizing or dimensioning of a heat transfer surface of a corresponding heat exchanger with a view to a particular minimum surface area is possible. The minimum surface area is necessary at least for transfer of a minimum amount of heat to the fluid, which minimum amount of heat prevents condensation of the fluid before, after and during the compression.

The surface sizing of the heat transfer surface, and therefore the production of the heat exchanger, are thus typically carried out while taking into account particular process conditions or process parameters of the thermodynamic process in which the heat exchanger to be produced is to be used. Corresponding process conditions or process parameters may, for example, be provided from databases and/or with the aid of simulations.

For the surface sizing of the heat transfer surface, in particular the molar mass of the fluid that is to be used or used in the scope of the thermodynamic process, in which the heat exchanger to be produced is used, is in this case of particular importance. It is because the principle according to the invention is based on the discovery that a correlation can be established between the molar mass of the fluid and the minimum surface area of the heat transfer surface. By means of this correlation, optimized surface sizing of the heat transfer surface is possible in a relatively straightforward way.

According to embodiments of the invention, the surface sizing of the heat transfer surface on the heat exchanger side is therefore carried out on the basis of a correlation between the molar mass of the fluid and the minimum surface area of the heat transfer surface. The minimum surface area is necessary at least for transfer of a minimum amount of heat, which minimum amount of heat prevents condensation in one or more fluids to be used with the heat exchanger to be produced, or produced, in the scope of a thermodynamic process of the fluid before, after and during the compression.

Besides, as mentioned, expediently predetermined process conditions or process parameters of the thermodynamic process, in which the heat exchanger to be produced is to be used, for carrying out the disclosed method knowledge about the molar mass of the fluid to be used, or used, in the thermodynamic process is thus necessary in particular. The molar mass of the fluid, if it is not known, may for example be taken from databases or determined with the aid of measurement methods known for determination of the molar mass of a fluid.

The actual manufacture of the heat exchanger carried out subsequently, i.e. after surface sizing or dimensioning of the heat transfer surface on the heat exchanger side, is carried out on the basis of the minimum surface area of the heat transfer surface. Depending on the materiality of the heat exchanger or of the heat transfer surface, respectively, known, in particular shaping manufacturing technology production processes, for example casting processes, stamping/bending processes etc., may be provided.

Specific embodiments of heat exchangers which may be produced by the disclosed method are, for example, double-tube, coaxial, plate, tube-bundle or coil heat exchangers.

All the comments below in the context of a thermodynamic process respectively relate to the thermodynamic process in which the heat exchanger to be produced, or the fluid, is to be used.

In the scope of the correlation between the molar mass of the fluid and the minimum surface area of the heat transfer surface, typically a correlation of the molar mass of the fluid with the inverse slope of the saturated vapor line of the fluid is initially carried out. Since the in principle fluid-specific inverse slope of the saturated vapor line depends in particular on the temperature of the fluid, the correlation between the molar mass and the inverse slope of the saturated vapor line of the fluid is expediently carried out for a (pre) determined temperature of the fluid. This is typically the evaporation temperature of the fluid, i.e. the temperature which the fluid has after evaporation and before superheating has taken place.

It has been possible to show and explain the correlation between the molar mass and the inverse slope of the saturated vapor line of corresponding fluids in tests. The tests gave, in particular, an (almost) linear relationship between the molar mass and the inverse slope of the saturated vapor line of corresponding fluids.

The expediency of using the inverse slope of the saturated vapor line results from the fact that some fluids to be used, or used, in corresponding thermodynamic processes have approximately isentropic and therefore vertical saturated vapor lines, and therefore very high slopes, for example in corresponding temperature/entropy diagrams, or T/S diagrams for short. Use of the inverse slope of the saturated vapor line of the fluid therefore allows, in particular, better comparability of a plurality of fluids considered.

The inverse slope of the saturated vapor line of the fluid is furthermore typically correlated with a minimum required temperature increase of the fluid starting from a given temperature, which minimum required temperature increase prevents condensation of the fluid before, after and during the compression. The given temperature is again expediently the evaporation temperature of the fluid, i.e. the temperature which the fluid has after evaporation. In tests, it has been possible to show and explain that there is an (almost) linear relationship between the minimum required temperature increase and the inverse slope of the saturated vapor line of the fluid.

The minimum required temperature increase thus determined is furthermore typically correlated with a minimum required enthalpy difference, which minimum required enthalpy difference represents the amount of heat which must be transferred to the fluid in order to prevent condensation of the fluid before, after and during the compression. The minimum required enthalpy difference therefore relates to the amount of heat which needs to be transferred via the heat transfer surface of the heat exchanger to the fluid in order to prevent condensation of the fluid before, after and during the compression. In tests, it has been possible to show and explain that there is also an (almost) linear relationship between the minimum required enthalpy difference, the inverse slope of the saturated vapor line of the fluid, and therefore also the molar mass of the fluid.

Subsequently, the minimum required enthalpy difference is typically correlated with the minimum surface area. In this way, it is thus finally possible to determine an area which corresponds to the minimum surface area of the heat transfer surface of the heat exchanger for the respective thermodynamic process in which the heat exchanger is to be used.

The correlation between the minimum required enthalpy difference and the minimum surface area is carried out, in particular, by means of the relationship $$\dot{m}\cdot\min\Delta h=k\cdot A\cdot\Delta T,$$

with $\dot{m}$=fluid mass flow rate, $\min\Delta h$=minimum required enthalpy difference, k=heat transfer coefficient, A=minimum surface area and $\Delta T$=temperature difference between a high-temperature side and a low-temperature side of the heat transfer surface of the heat exchanger.

It is in this case expedient to assume a particular heat transfer coefficient k and a particular temperature difference $\Delta T$, in particular as a function of the fluid or its chemical composition, the material forming the heat exchanger and optionally further process conditions or process parameters of the thermodynamic process.

Thus, in the scope of the correlation between the molar mass of the fluid and the minimum surface area, at least at least one particular temperature, i.e. in particular the temperature of the fluid after the evaporation, and/or a particular heat transfer coefficient k and/or a particular temperature difference $\Delta T$ between a high-temperature side and a low-temperature side of the heat transfer surface is used as a constraint.

At this point, it should again be mentioned that particular process conditions or process parameters of the thermodynamic process may be defined in the scope of the disclosed method as a constraint. These also include, in particular, predeterminable or predetermined operating parameters, i.e. in particular powers or power consumptions, individual or multiple devices connected into the thermodynamic process, which are configured or designed for condensation, expansion, evaporation or compression of the fluid. For example, these accordingly include the power of a condensation device connected into the thermodynamic process for condensing the (gaseous) fluid.

The correlation carried out in the scope of the disclosed method between the molar mass of the fluid and the minimum surface area of the heat transfer surface is typically carried out for a fluid, in particular an organic fluid, having a molar mass of more than 150 g/mol. In its temperature/entropy diagram, or T/S diagram for short, this fluid has an in particular strongly overhanging two-phase region. There is generally an overhanging two-phase region when the saturated vapor line of the fluid in such a T/S diagram is inclined at least in sections, in particular predominantly, in the direction of increasing entropy.

Specific examples of such fluids are, in a nonexhaustive list: perfluoromethylbutanone, perfluoromethylpentanone (brand name Novec™ 649) or perfluoromethylhexanone. These are each complex organic fluoroketone compounds. These fluids are furthermore distinguished by good environmental compatibility as well as their safety properties, for example no combustibility and a very low global warming potential.

Some embodiments furthermore relate to a heat exchanger for use in a thermodynamic process in which a fluid is condensed, expanded, evaporated and compressed in a cycle process. The heat exchanger comprises at least one heat transfer surface. The heat exchanger is distinguished in that it is produced by the method described above. Accordingly, all comments relating to the disclosed method apply similarly for the heat exchanger according to the invention.

The heat exchanger may be for example a double-tube, coaxial, plate, tube-bundle or coil heat exchanger.

Other embodiments of the invention relate to the use of such a heat exchanger in a thermodynamic process in which a fluid is condensed, expanded, evaporated and compressed in a cycle process. For the use of the heat exchanger in such a thermodynamic process, all comments relating to the method according to the invention also apply similarly.

FIG. 1 shows an outline representation of a heat exchanger 1 connected into a thermodynamic process, according to one exemplary embodiment of the invention.

The thermodynamic process, which may for example be implemented in a Reverse-Rankine process in a refrigerating machine or a heat pump, comprises the steps carried out in succession in a cycle process: evaporation of a liquid fluid, compression of the fluid which is gaseous after the evaporation, condensation of the compressed gaseous fluid, and expansion of the condensed fluid which is liquid after the compression. The expanded fluid which is in the liquid state is recompressed and the cycle process begins again.

The respective steps are carried out by corresponding devices connected into the thermodynamic process. These include an evaporation device 2 for evaporating the fluid, a compression device 3 connected downstream thereof in the fluid flow for compressing the fluid, a condensation device 4 connected downstream thereof in the fluid flow, typically in the form of a compressor, for condensing the fluid, and an expansion device 5 connected downstream thereof in the fluid flow, typically in the form of an expansion valve, for expanding the fluid.

As can be seen, the heat exchanger 1 is connected between the evaporation device 2 and the compression device 3. A heat transfer surface, belonging to the high-temperature side of the heat exchanger 1, is accordingly assigned to the fluid flow between the evaporation device 2 and the compression device 3. A heat transfer surface belonging to the low-temperature side of the heat exchanger 1 is assigned to the fluid flow between the condensation device 4 and the expansion device 5.

The fluid is, for example, a fluoroketone known by the brand name Novec™ 649.

The heat exchanger 1 is produced by means of a special production method. The method therefore relates in general to the production of a heat exchanger 1 comprising at least one heat transfer surface, which heat exchanger 1 is to be used in a thermodynamic process in which a fluid that is condensed, expanded, evaporated and compressed in a cycle process is used.

According to the method, besides other manufacturing technology production steps for forming the heat exchanger 1, particular surface sizing or dimensioning of the heat transfer surface on the heat exchanger side is carried out. The surface sizing or dimensioning of the heat transfer surface is carried out so that it has a minimum surface area. The minimum surface area is necessary at least for transfer of a minimum amount of heat to a fluid to be used with the heat exchanger 1 to be produced in the scope of a thermodynamic process. The minimum amount of heat is the amount of heat which prevents condensation of the fluid before, after and during the compression.

The heat transfer surface on the heat exchanger side is thus sized with a view to particular process conditions or process parameters of the thermodynamic process so that a sufficient amount of heat can be transferred to the fluid via the heat transfer surface which prevents condensation of the fluid before, after and during the compression. In this way, it is possible to prevent damage to the compression device 3 by so-called liquid slugging.

In the scope of the method, the surface sizing of the heat transfer surface on the heat exchanger side is carried out on the basis of a correlation between the molar mass M of the fluid and the minimum surface area.

Besides expediently predetermined process conditions or process parameters of the thermodynamic process in which the heat exchanger 1 to be produced is to be used, in order to carry out the method according to the invention knowledge about the molar mass M of the fluid to be used, or used, in the thermodynamic process is thus necessary in particular.

In the scope of the correlation between the molar mass M of the fluid and the minimum surface area of the heat transfer surface, a correlation, i.e. establishment of a relationship, between the molar mass M of the fluid with the inverse slope of the saturated vapor line of the fluid is initially carried out. The inverse slope of the saturated vapor line is respectively shortened to "IS" in the diagrams shown in FIGS. 2, 4 and 5.

Since the in principle fluid-specific inverse slope of the saturated vapor line depends in particular on the temperature of the fluid, the correlation between the molar mass M of the fluid and the inverse slope of the saturated vapor line of the fluid is expediently carried out for a given temperature of the fluid. The temperature may, for example, be the evaporation temperature of the fluid, i.e. the temperature which the fluid has after evaporation, i.e. after leaving the evaporation device 2.

Figure 2:
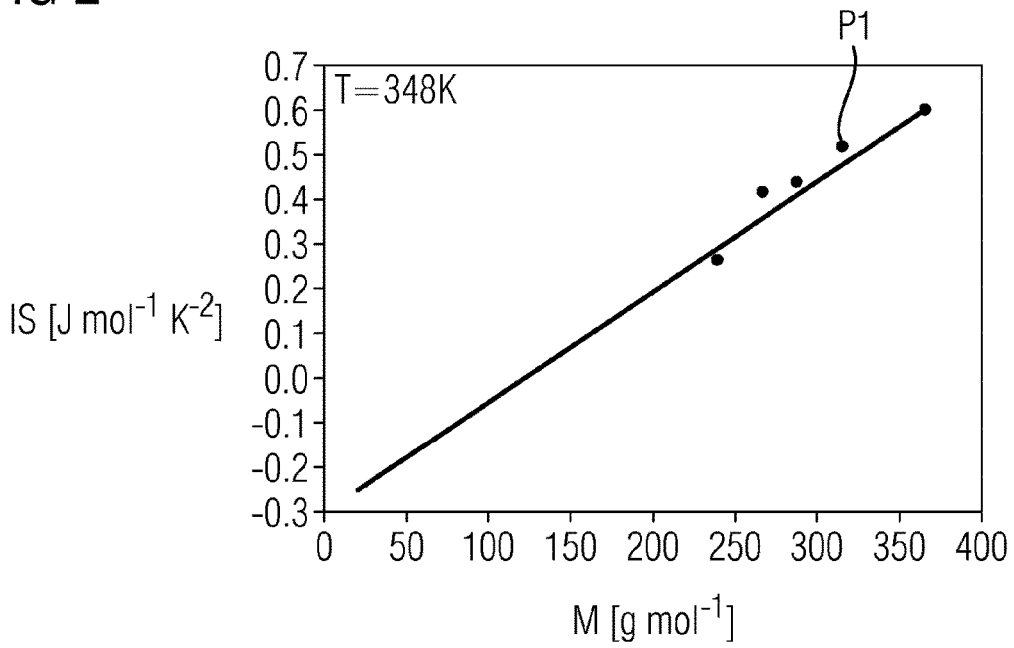
FIG. 2 shows a diagram to illustrate the correlation between the molar mass of a fluid and of the inverse slope of the saturated vapor line of the fluid.

FIG. 2 shows a diagram to illustrate the correlation between the molar mass M of a fluid (x axis) and the inverse slope of the saturated vapor line of the fluid (y axis).

Various fluids, in particular fluoroketones, are plotted at a temperature of 348 K. This temperature corresponds typically to the evaporation temperature of a fluid in the scope of the thermodynamic process. The evaporation temperature of the fluid is, as mentioned, the temperature which the fluid has after leaving the evaporation device 2.

With the aid of FIG. 2, it can be seen that there is an (almost) linear relationship between the molar mass M and the inverse slope of the saturated vapor line of corresponding fluids.

The expediency of using the inverse slope of the saturated vapor line of corresponding fluids due to the fact that many fluids to be used, or used, in corresponding thermodynamic processes have approximately vertical saturated vapor lines, and therefore very high slopes. Use of the inverse slope of the saturated vapor line therefore allows better comparability of a plurality of fluids considered.

The progress of the method will be discussed below with the aid of the perfluoromethylpentanone (brand name Novec™ 649) having a molar mass M of about 316 g/mol. With the aid of FIG. 2, it can be seen that the inverse slope of the saturated vapor line of this fluid is 0.562 J $mol^{-1}$ $K^{-2}$. The inverse slope of the saturated vapor line of the fluid may therefore, in particular, also be determined or ascertained graphically.

The inverse slope of the saturated vapor line is subsequently correlated with a minimum required temperature increase of the fluid starting from the assumed temperature, i.e. here starting from 348 K. The minimum required temperature increase of the fluid is the temperature increase which is at least required in order to prevent condensation of the fluid before, after and during the compression. For more detailed explanation of the determination of the minimum required temperature increase, reference is made to FIG. 3, which shows a temperature/entropy diagram, or T/S diagram for short, for a fluid used in a thermodynamic process. The temperature T of the fluid is plotted on the y axis, and the entropy S of the fluid is plotted on the x axis.

Figure 3:
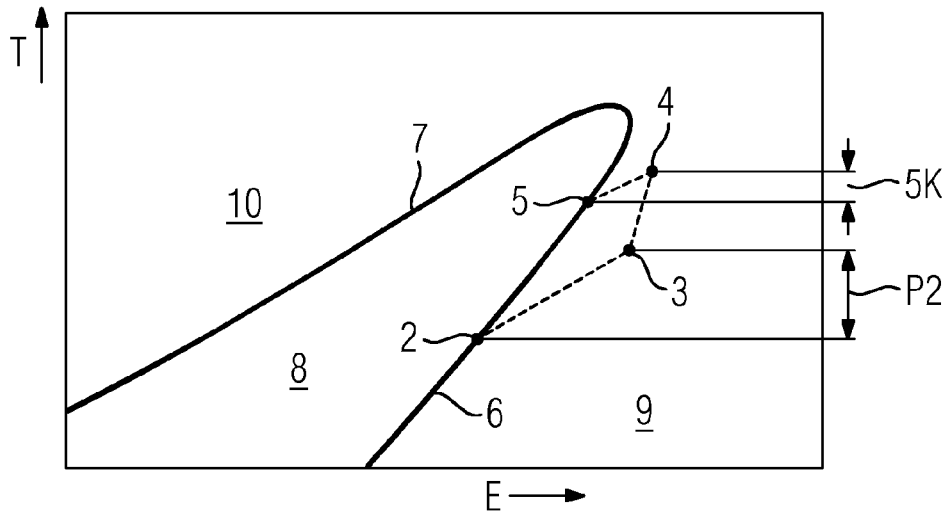
FIG. 3 shows a temperature/entropy diagram for a fluid used in a thermodynamic process.

Essentially, with the aid of the T/S diagram shown in FIG. 3, it is possible to see in particular a saturated vapor line 6 of the fluid (cf. the right-hand branch of the graph), a boiling line of the fluid (cf. the left-hand branch of the graph) and a two-phase region 8 of the fluid. In the two-phase region 8, the fluid is in two phases, i.e. a gaseous phase and a liquid phase. In the area 9 lying to the right of the saturated vapor line 6, the liquid is gaseous, and in the area 10 lying to the left of the boiling line 7, the fluid is liquid.

As can be seen, the fluid has a strongly overhanging two-phase region 8. This can be seen from the fact that the saturated vapor line 6 of the fluid is strongly inclined in the direction of increasing entropy.

The devices connected into the thermodynamic process, which were described with reference to FIG. 1, are likewise entered in FIG. 3. To the right of the reference line 2, the fluid has accordingly left the evaporation device 3 (without taking into account possible overheating in the evaporation device 2), to the left of the reference line 3 the fluid has left the compression device 3, etc. The compression of the fluid thus takes place between the reference lines 3 and 4.

The minimum required temperature increase, which can be seen in FIG. 3 by the double arrow P2, is abbreviated to "minΔT" and is given by the following formulae (1)-(5):

$$\min\Delta T = T_3 - T_2 \tag{1}$$

with: $T_3$=temperature of the fluid when entering the compression device 3; $T_2$=temperature of the fluid when leaving the evaporation device 2.

The following applies in this case:

$$T_3 = f(p_2, h_3) \tag{2}$$

with: $p_2$=pressure of the fluid when leaving the evaporation device 2; $h_3$=enthalpy of the fluid when entering the compression device 3.

The following applies in this case:

$$h_3=h_4-(h_4-h_{3S})/\eta_S \quad (3)$$

with: $h_4$=enthalpy of the fluid when entering the condensation device 4; $h_{3S}$=enthalpy of the fluid when entering the compression device 3 in the case of an ideal efficiency of the thermodynamic process of 1; $\eta_S$=actual efficiency of the thermodynamic process, an efficiency of about 0.8 typically being assumed.

The following applies in this case:

$$h_4=f(T_4+5K;p_4) \quad (4)$$

with: $T_4$=temperature of the fluid when leaving the condensation device 4, 5 K being added to this temperature in order to ensure that the fluid remains in the gaseous state; $p_4$=pressure of the fluid when leaving the condensation device 4.

Figure 4:
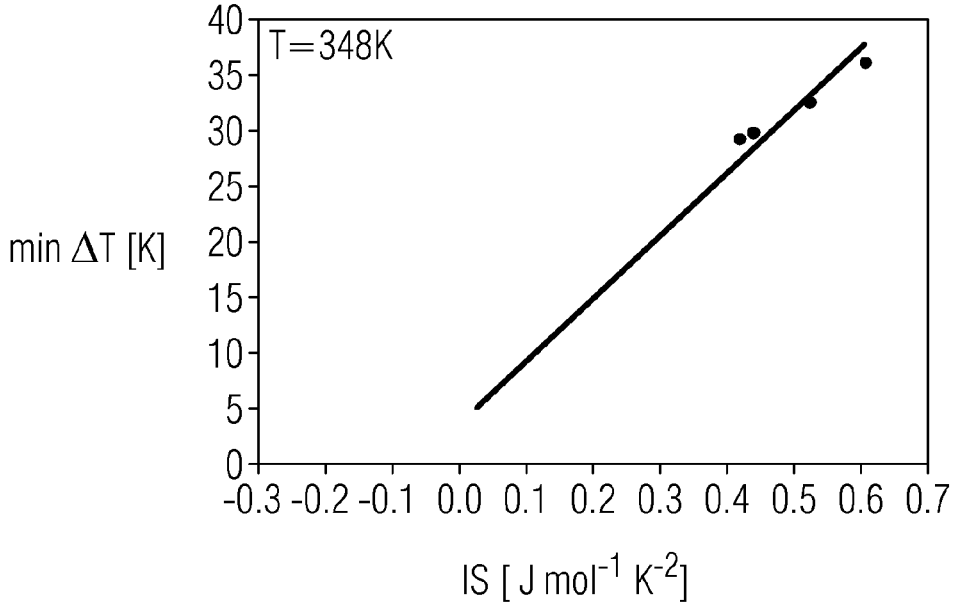
FIG. 4 shows a diagram to illustrate the correlation between the inverse slope of the saturated vapor line of a fluid and the minimum required temperature increase.

The following further applies:

$$h_{3S}=f(p_2;S_4) \quad (5)$$

with: $p_2$=pressure of the fluid when leaving the evaporation device 2; $S_4$=entropy of the fluid when entering the condensation device 4. FIG. 4 shows a diagram to illustrate the correlation between the inverse slope of the saturated vapor line of a fluid (x axis) and the minimum required temperature increase min$\Delta$T (y axis) which prevents condensation of the fluid in a thermodynamic process before, during and after the compression.

With the aid of FIG. 4, it can be seen that there is an (almost) linear relationship between the inverse slope of the saturated vapor line and the minimum required temperature increase min$\Delta$T of corresponding fluids.

The minimum required temperature increase min$\Delta$T which can be or is determined in this way is subsequently correlated with a minimum required enthalpy difference min$\Delta$h. The minimum required enthalpy difference min$\Delta$h represents the amount of heat which must be transferred to the fluid in order to prevent condensation of the fluid before, after and during the compression. The minimum required enthalpy difference min$\Delta$h is therefore to be understood as the amount of heat which must be transferred to the fluid via the heat transfer surface of the heat exchanger in order to prevent condensation before, after and during the compression.

Figure 5:
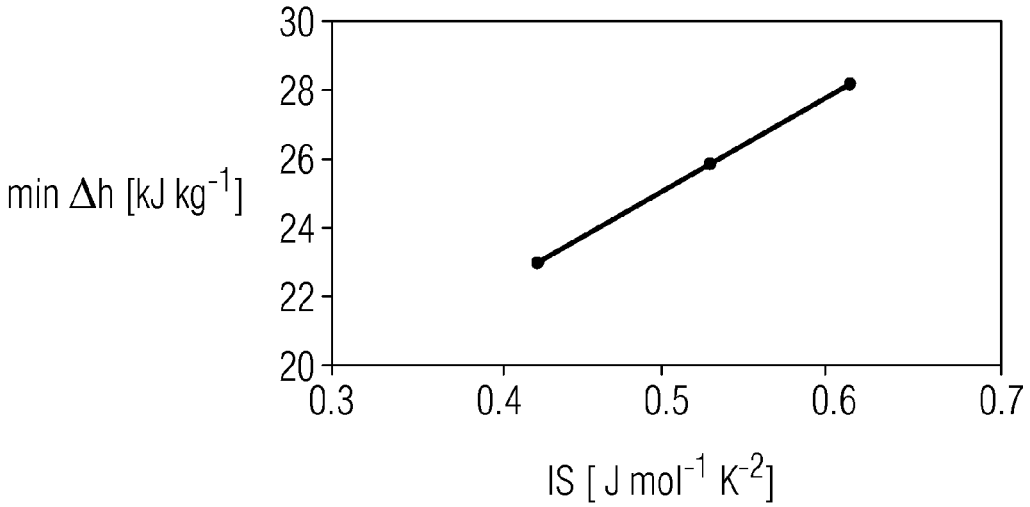
FIG. 5 shows a diagram to illustrate the correlation between the inverse slope of the saturated vapor line of a fluid and of a minimum required enthalpy difference.

FIG. 5 shows a diagram to illustrate the correlation between the inverse slope of the saturated vapor line of a fluid (x axis) and the minimum required enthalpy difference min$\Delta$h (y axis) which, as mentioned, represents the amount of heat which must be transferred to the fluid in order to prevent condensation of the fluid in a thermodynamic process before, after and during the compression.

With the aid of FIG. 5, it can be seen that there is also an (almost) linear relationship between the minimum required enthalpy difference min$\Delta$h and the inverse slope of the saturated vapor line of the fluid, and therefore also the molar mass M of the fluid.

The minimum required enthalpy difference min$\Delta$h is subsequently correlated with the minimum surface area of the heat transfer surface. An area A is thus finally determined which corresponds to the minimum surface area of the heat transfer surface of the heat exchanger 1.

The correlation between the minimum required enthalpy difference min$\Delta$h and the minimum surface area is carried out by means of the following relationship:

$$\dot{m}\cdot\min\Delta h=k\cdot A\cdot\Delta T,$$

with $\dot{m}$=fluid mass flow rate, min$\Delta$h=enthalpy difference, k=heat transfer coefficient, A=minimum surface area and $\Delta$T=temperature difference between a high-temperature side and a low-temperature side of the heat transfer surface.

A particular heat transfer coefficient k and a particular temperature difference $\Delta$T are in this case assumed, in particular as a function of the fluid or its chemical composition, the material forming the heat exchanger 1 and optionally further process conditions or process parameters of the thermodynamic process.

In the scope of the correlation between the molar mass M of the fluid and the minimum surface area of the heat transfer surface, at least a particular temperature, in particular the temperature of the fluid after the evaporation, and/or a particular heat transfer coefficient k and/or a particular temperature difference $\Delta$T between a high-temperature side and a low-temperature side of the heat transfer surface on the heat exchanger side is thus used as a constraint.

In the scope of the method, particular process conditions or process parameters of the thermodynamic process are therefore defined as constraints. These also include in particular predeterminable or predetermined operating parameters, i.e. in particular powers or power consumptions, individual or multiple devices connected into the thermodynamic process, which are configured or designed for condensation, expansion, evaporation or compression of the fluid. For example, these include a condensation device connected 4 into the thermodynamic process for condensing the fluid.

In respect of the minimum surface area, to be determined, of the heat transfer surface, it applies qualitatively that this is proportional to the amount of heat to be transferred to the fluid via the heat transfer surface on the heat exchanger side. The smaller the minimum required enthalpy difference min$\Delta$h, the smaller the minimum surface area of the heat transfer surface on the heat exchanger side likewise is.

The correlation carried out in the scope of the invention between the molar mass M of the fluid and the minimum surface area of the heat transfer surface on the heat exchanger side is typically carried out for a fluid, in particular an organic fluid, having a molar mass of more than 150 g/mol. Such fluids typically have an in particular strongly overhanging two-phase region in their temperature/entropy diagram, or T/S diagram for short.

Exemplary data of a minimum surface area determined in the scope of the invention will be presented below. The fluid in which the data are based is the aforementioned perfluoromethylpentanone having a molar mass M of 316 g/mol.

A power Q of 1000 kW in the condensation device 4, an average temperature difference $\Delta$T of 10 K and a heat transfer coefficient k of 200 W $m^{-2}$ $K^{-1}$ were assumed. In principle, average temperature differences $\Delta$T of between 5 and 30 K and a heat transfer coefficient of between 50 and 1000 W $m^{-2}$ $K^{-1}$ should be assumed.

| M [g/mol] | m [kg/s] | $\Delta h_4$ [kJ/kg] | Q [kW] | min$\Delta$h [kJ/kg] | $Q_1$ [kW] | k [kW/$m^2$K] | $\Delta$T [K] | A [$m^2$] |
|---|---|---|---|---|---|---|---|---|
| 316 | 12.8 | 78.0 | 1000 | 25.9 | 332 | 0.2 | 10 | 166 |

The method according to the invention therefore makes it possible in a straightforward way to determine a heat transfer surface on the heat exchanger side which is suitable for a particular thermodynamic process. On the basis of the molar mass M of the fluid to be used, or used, in the thermodynamic process, it is possible to deduce the inverse slope of the saturated vapor line of the fluid, the minimum required temperature increase minΔT, the minimum required enthalpy difference minΔh and furthermore a corresponding minimum surface area of a heat transfer surface on the heat exchanger side.

Although the invention has been illustrated and described in detail with the exemplary embodiment, the invention is not restricted to the examples disclosed, and other variants may be derived therefrom by the person skilled in the art without departing from the protective scope of the invention.

What is claimed is:

1. A method for producing a heat exchanger to be used in a thermodynamic process that uses a fluid that is condensed, expanded, evaporated and compressed in a cycle process comprising: selecting a surface size of a heat transfer surface of the heat exchanger, including: determining a minimum surface area of the heat transfer surface, the minimum surface area enabling a defined minimum amount of heat transfer to the fluid to be used with the heat during the thermodynamic process in order to prevent condensation of the fluid before, after, and during the compression of the fluid in the cycle process, performing a correlation between the molar mass of the fluid and the determined minimum surface area of the heat transfer surface, and selecting the surface size of the heat transfer surface based at least on the determined minimum surface area and the correlation between the molar mass of the fluid and the determined minimum surface area, and producing the heat exchanger with the heat transfer surface having the selected size.

2. The method of claim 1, wherein the molar mass of the fluid is initially correlated with an inverse slope of a saturated vapor line of the fluid.

3. The method of claim 2, wherein the inverse slope of the saturated vapor line is additionally correlated with a minimum required temperature increase of the fluid starting from a given temperature, which minimum required temperature increase prevents condensation of the fluid before, after, and during the compression of the fluid.

4. The method of claim 3, wherein the minimum required temperature increase is additionally correlated with a minimum required enthalpy difference that represents a required amount of heat transfer to the fluid to prevent condensation of the fluid before, after, and during the compression of the fluid.

5. The method of claim 4, wherein the minimum required enthalpy difference is correlated with the minimum surface area.

6. The method of claim 5, wherein the correlation between the minimum required enthalpy difference and the minimum surface area is based on the relationship $\dot{m}\cdot \min\Delta h = k\cdot A\cdot \Delta T$, wherein $\dot{m}$=fluid mass flow rate, $\min\Delta h$=minimum required enthalpy difference, k=heat transfer coefficient, A=minimum surface area, and ΔT=temperature difference between a high-temperature side and a low-temperature side of the heat transfer surface.

7. The method of claim 1, wherein the correlation between the molar mass of the fluid and the minimum surface area includes a constraint based on at least one of the temperature of the fluid after the evaporation, a particular heat transfer coefficient, or a particular temperature difference between a high-temperature side and a low-temperature side of the heat transfer surface.

8. The method of claim 1, wherein the correlation is performed for a fluid having a molar mass of more than 150 g/mol.

9. A heat exchanger for use in a thermodynamic process in which a fluid is condensed, expanded, evaporated and compressed in a cycle process, wherein the heat exchanger comprises at least one heat transfer surface, the heat exchanger produced by a method comprising:

selecting a surface size of a heat transfer surface of the heat exchanger, including:

determining a minimum surface area of the heat transfer surface, the minimum surface area enabling a defined minimum amount of heat transfer to the fluid to be used with the heat exchanger during the thermodynamic process in order to prevent condensation of the fluid before, after, and during the compression of the fluid in the cycle process, performing a correlation between the molar mass of the fluid and the determined minimum surface area of the heat transfer surface, and selecting the surface size of the heat transfer surface based at least on the determined minimum surface area and the correlation between the molar mass of the fluid and the determined minimum surface area, and producing the heat exchanger with the heat transfer surface having the selected size.

10. The heat exchanger of claim 9, wherein the molar mass of the fluid is initially correlated with an inverse slope of a saturated vapor line of the fluid.

11. The heat exchanger of claim 10, wherein the inverse slope of the saturated vapor line is additionally correlated with a minimum required temperature increase of the fluid starting from a given temperature, which minimum required temperature increase prevents condensation of the fluid before, after, and during the compression of the fluid.

12. The heat exchanger of claim 11, wherein the minimum required temperature increase is additionally correlated with a minimum required enthalpy difference that represents a required amount of heat transfer to the fluid to prevent condensation of the fluid before, after, and during the compression of the fluid.

13. The heat exchanger of claim 12, wherein the minimum required enthalpy difference is correlated with the minimum surface area.

14. The heat exchanger of claim 13, wherein the correlation between the minimum required enthalpy difference and the minimum surface area is based on the relationship $\dot{m}\cdot \min\Delta h = k\cdot A\cdot \Delta T$, wherein $\dot{m}$=fluid mass flow rate, $\min\Delta h$=minimum required enthalpy difference, k=heat transfer coefficient, A=minimum surface area, and ΔT=temperature difference between a high-temperature side and a low-temperature side of the heat transfer surface.

15. The heat exchanger of claim 9, wherein the correlation between the molar mass of the fluid and the minimum surface area includes a constraint based on at least one of the temperature of the fluid after the evaporation, a particular heat transfer coefficient, or a particular temperature difference between a high-temperature side and a low-temperature side of the heat transfer surface.

16. The heat exchanger of claim 9, wherein the correlation is performed for a fluid having a molar mass of more than 150 g/mol.

17. Use of a heat exchanger in a thermodynamic process in which a fluid is condensed, expanded, evaporated and compressed in a cycle process, wherein the heat exchanger comprises at least one heat transfer surface, the heat exchanger produced by a method comprising:

selecting a surface size of a heat transfer surface of the heat exchanger, including:

determining a minimum surface area of the heat transfer surface, the minimum surface area enabling a defined minimum amount of heat transfer to the fluid to be used with the heat exchanger during the thermodynamic process in order to prevent condensation of the fluid before, after, and during the compression of the fluid in the cycle process, performing a correlation between the molar mass of the fluid and the determined minimum surface area of the heat transfer surface, and selecting the surface size of the heat transfer surface based at least on the determined minimum surface area and the correlation between the molar mass of the fluid and the determined minimum surface area, and producing the heat exchanger with the heat transfer surface having the selected size.

* * * * *